US007001312B2

(12) United States Patent
Alessandri et al.

(10) Patent No.: US 7,001,312 B2
(45) Date of Patent: Feb. 21, 2006

(54) SUPPORT DEVICE, WITH DAMPING, FOR A MOBILE PART OF AN EXERCISE APPARATUS

(75) Inventors: Nerio Alessandri, Longiano (IT); Gianmatteo Fabbri, Rimini (IT)

(73) Assignee: Technogym S.p.A., Gambettola (IT)

( * ) Notice: Subject to any disclaimer, the term of this patent is extended or adjusted under 35 U.S.C. 154(b) by 0 days.

(21) Appl. No.: 10/645,586

(22) Filed: Aug. 22, 2003

(65) Prior Publication Data

US 2004/0058786 A1 Mar. 25, 2004

(30) Foreign Application Priority Data

Aug. 27, 2002 (IT) ..... BO2002A0547

(51) Int. Cl.
*A63B 22/02* (2006.01)

(52) U.S. Cl. ..... 482/54; 482/92; 482/1

(58) Field of Classification Search ..... 482/51–54, 482/1–8, 92–93; 188/378, 317, 171
See application file for complete search history.

(56) References Cited

U.S. PATENT DOCUMENTS 3,464,657 A 9/1969 Bullard ..... 248/20
3,831,942 A * 8/1974 Del Mar ..... 482/72
4,849,666 A 7/1989 Hoag ..... 310/90.5
5,051,638 A * 9/1991 Pyles ..... 310/105
5,711,404 A * 1/1998 Lee ..... 188/164
5,735,777 A * 4/1998 Benoit et al. ..... 482/93
5,752,879 A 5/1998 Berdut ..... 482/96
5,993,358 A 11/1999 Gureghian et al. ..... 482/54
6,318,517 B1 * 11/2001 Chang ..... 188/161

FOREIGN PATENT DOCUMENTS

WO PCT/IB02/00575 9/2002
WO WO 02/068066 A1 9/2002

* cited by examiner

*Primary Examiner*—Stephen R. Crow
(74) *Attorney, Agent, or Firm*—Arent Fox PLLLC

(57) ABSTRACT

In an exercise apparatus comprising a fixed support member (3) and a moving part (2) which can perform movements correlated to the exchange of forces between a user and the apparatus, a support device (1) comprises: elastic supporting means (4); means (6) for damping the movements of the moving part (2) and adjusting means (7). The damping means (6) are arranged parallel with the supporting means (4) and comprise a magnetic actuator (8), in which a first, moving component (9) has an electroconductive element (11), and a second, fixed component (10) comprises a permanent magnet (12) and a non-permanent magnet (13) connected to one another to form at least one air gap (14) which houses the electroconductive element (11). Electrical energizing of the electroconductive element (11), whether generated or induced, applies to the first component (9) of the actuator (8) a reactive magnetic force which opposes the translational movement.

31 Claims, 5 Drawing Sheets

SUPPORT DEVICE, WITH DAMPING, FOR A MOBILE PART OF AN EXERCISE APPARATUS

BACKGROUND OF THE INVENTION

The present invention relates to apparatuses for personal physical exercise, that is to say, to equipment, devices and machines designed for carrying out assisted motor activity for the most widespread purposes, such as recreation and fun, to achieve and maintain physical fitness and well-being, rehabilitation, gymnastics and sports training.

The present invention relates in particular to a support device designed to dampen and cushion the mobility of a moving part of an exercise apparatus.

In some exercise apparatuses and machines, of various types and of known construction, generally having moving parts, yieldingly supported by a fixed support member, support devices are used which basically comprise elastic supporting means and electromagnetic damping means suitably combined with one another.

In a device of this type, for example described in patent application PCT/IB02/00575 in the name of the same Applicant, the elastic supporting means are in particular helical springs, inserted between the moving part and the fixed support member. The damper means consist of solenoid valves in which a ferromagnetic core, inside a tubular coil, connected to an electric circuit, under the effect of the magnetic field generated by electrically energizing the coil, is moved longitudinally to the tube shape, creating a pushing or pulling action in the coil axial direction.

These damper means are connected to the moving part and to the fixed support member in such a way as to exert their action, coaxial to the coil, in series and opposing the action of the elastic means.

Therefore, in terms of operation, the springs provide the elastic reaction to the moving part of the exercise apparatus. The electromagnets, counteracting the latter, dampen the oscillations associated with movement of the moving part about its point of equilibrium. Moreover, due to the special structural link between the electromagnets and the spring, the electromagnets being arranged in series, as indicated, the latter can influence the intrinsic rigidity of the spring, varying it.

Adjusting means make the performance of the support device adjustable by adjusting the parameters for electrical energizing of the coil. This adjustment is conveniently controlled according to input signals suitably selected amongst the system mechanical parameters, for example, the instantaneous movement of the moving part relative to a suitable reference; the force exchanged between the moving part and the user; the weight of the user, etc.

Support devices designed in this way have the disadvantage of, generally speaking, having structures with large overall masses and which also require the presence of suspended masses whose incidence on the total masses is rather large.

These features have a negative effect on the weight of the exercise apparatus for which the device is intended and an equally negative influence on the device response speed, also compromising its application on those exercise apparatuses which, more than others, involve dynamic actions during their use.

The above-mentioned structures also have large overall dimensions which affect the method used for application to the parts of the machine.

In various types of exercise apparatuses these support devices do not have enough space to allow them to be positioned between the moving part and the fixed support member. Therefore, since the support devices have to be positioned at the side of them, they compromise machine overall dimensions in general in the direction transversal to the movement they are allowed to perform.

Another disadvantage is the fact that the series connection between the elastic part and the damper element means that the damping which can effectively be used is only in one axial direction of the coil.

A further disadvantage is the fact that the range of the damping strokes is almost the same as those allowed by conventional support devices, fitted only with elastic means, in which damping occurs only by natural energy dissipation.

The aim of the present invention is, therefore, to overcome the above-mentioned disadvantages.

SUMMARY OF THE INVENTION

Accordingly, the invention achieves said aim by providing a damping support device for an exercise apparatus, in which the apparatus comprises a moving part and a fixed support member. The moving part can perform movements, towards or away from the fixed support member, correlated with the exchange of forces between the user and the apparatus. The device comprises supporting means with at least one elastic element positioned between the moving part and the fixed support member, means for damping the movements of the moving part relative to the support member; and means for adjusting the degree of damping. In the device according to the invention, the damping means comprise at least one magnetic actuator with a first moving component, integral with the moving part of the apparatus, and a second, fixed component, integral with the relative support member. Either the first or second component of the actuator has an electroconductive element designed to be the seat of an electromotive force, the other component comprising a permanent magnet and a non-permanent magnet, connected to one another in such a way as to form at least one air gap designed to radiate a magnetic field passing through the electroconductive element. Electrical energizing of the electroconductive element produces a reactive magnetic force which, when applied to the moving component of the first and second component, counteracts its translation in the direction of the movements of the moving part of the apparatus.

Parallel mounting of the elastic elements and the damping means allows a reduced reciprocal influence by said parts of the device, with more effective control and adjustment of the elastic reaction on one side and the damping on the other.

The device also benefits from smaller masses, in terms of both overall masses and suspended masses, allowing: the advantage of a reduction in weights; the advantage of a more rapid device response capacity; greater possibilities for adjustment and greater versatility in terms of use of the device.

The device made in this way is advantageously applied both in apparatuses in which the exchange of forces occurs with mainly static methods—so-called isotonic machines—and in apparatuses in which the exchange of force occurs in dynamic conditions (so-called cardio machines).

Another advantage linked mainly to the structure of the damping means is that they allow bi-directional damping, that is to say, both active and passive damping, obviously allowing a wider range of possible adjustments.

As regards construction dimensions, the present invention allows a reduction of the dimensions which permits its positioning between the moving part and the fixed structure relative to which said part can move. The resulting overall dimensions for exercise apparatuses which use the device are not, therefore, greater than those typical of apparatuses with conventional construction.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

With reference to the accompanying drawings, the numeral 1 denotes a damping support device for general use in exercise apparatuses. The apparatuses referred to have the most varied structures and shapes and are intended for the most general types of use: play, rehabilitation, exercise or sports. They are linked to one another by the fact that they have a moving part 2 and a support member 3, which is fixed relative to the moving part 2 and can perform movements, towards or away from the latter, correlated with the exchange of forces between the user and the apparatus while performing the various physical exercises.

Figure 10:
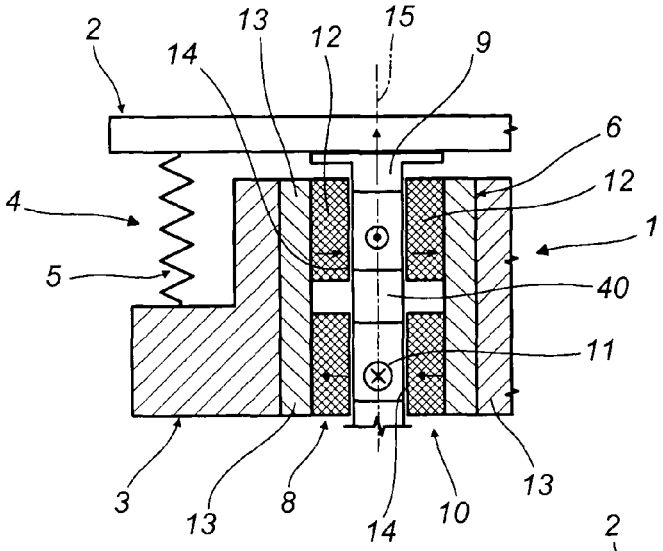
FIGS. 10 and 11 are diagrams—created in different graphic scales—illustrating the operating principle of a first embodiment of a device made in accordance with the present invention.

The device 1—which can be applied in many different construction solutions, only some of which are schematically illustrated by way of example, without limiting the scope of the invention—basically comprises (see FIG. 10) supporting means, labeled 4 as a whole and damping means, labeled 6 as a whole.

The supporting means 4 comprise one or more elastic elements 5—helical springs—operatively positioned between the moving part 2 and the fixed support member 3 of the generic exercise apparatus.

The damping means 6 are positioned parallel with the supporting means 4 and comprise in particular a magnetic actuator, labeled 8 as a whole, which has a first, moving component 9, integral with the moving part 2 of the apparatus, and a second, fixed component, labeled 10 as a whole, integral with the relative support member 3.

Figure 11:
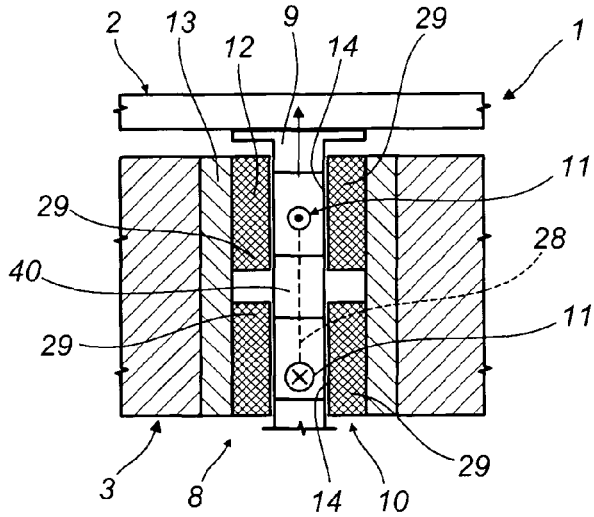
Figure 13:
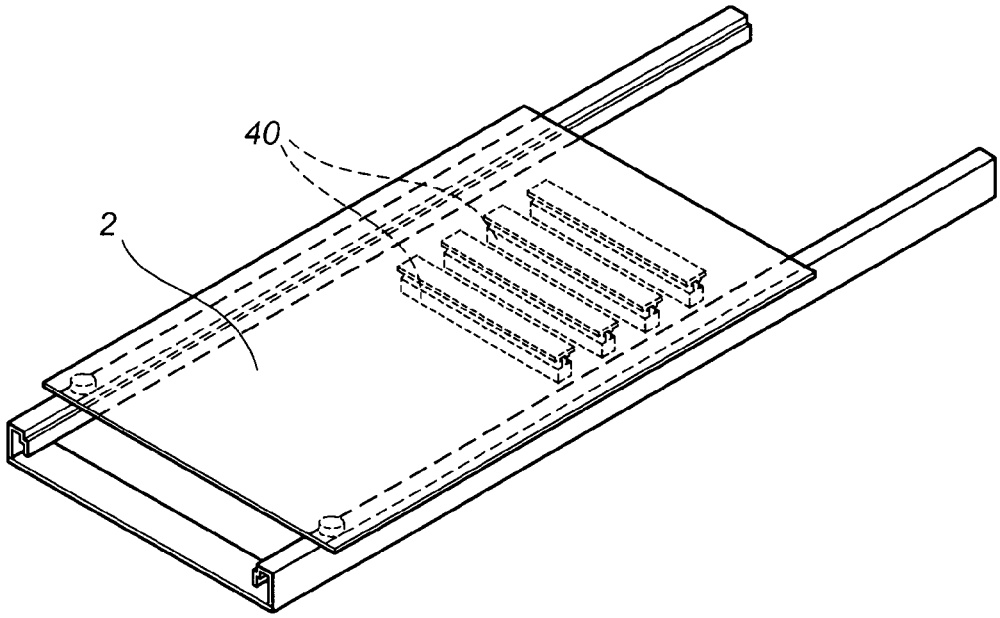
FIG. 13 is a schematic perspective view, with some parts cut away to better illustrate others, of the exercise apparatus illustrated in FIG. 1 and of an embodiment of some components of the relative support device.
Figure 14:
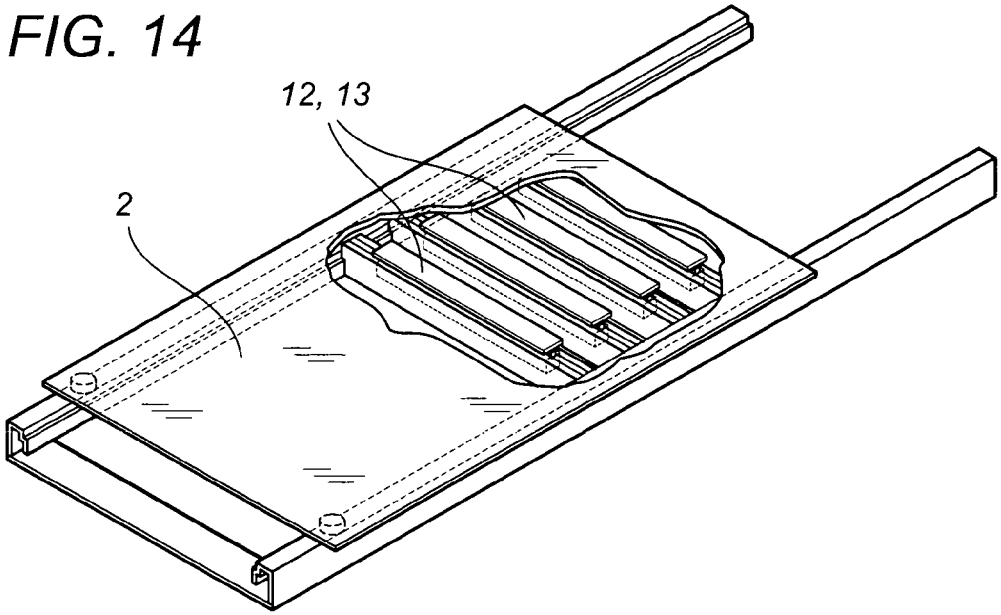
FIG. 14 is a schematic perspective view of the exercise apparatus illustrated in FIG. 13, with reference to other components of the relative support device.

FIG. 11 more clearly illustrates how the first component 9 of the actuator 8 consists of a core 40—for example in the form of a bar attached to the moving part (FIG. 13)—which has an electroconductive element 11 designed to act as the seat of an electromotive force and which can be made according to two different construction layouts.

In a first embodiment, the electroconductive element 11 is a coil 11. The coil is made using a conducting wire, preferably made of copper, which is connected to the core 40 in such a way as to form one or more loops 28, lying in a plane parallel with the axial direction 15 of the core 40 and designed so that the electric current passes through them in directions symbolically indicated in the drawing.

The second component 10 of the actuator comprises two magnets 12 and 13 set opposite one another and on either side of the first component 9. The magnets are connected to one another to form a single magnetic circuit.

More particularly, one of the magnets, to be precise the magnet adjacent to the first component 9, is a permanent magnet 12. The other, more external magnet 13—hereinafter referred to as a non-permanent magnet—consists of a bar of ferromagnetic material, in particular soft iron, adjacent to the permanent magnet 12, side-by-side with it and further from the core 40 than the latter.

The permanent magnet 12 (better illustrated in FIG. 11) has two pairs of pole shoes 29 forming an air gap 14 housing the first, moving component 9 of the actuator 8. The magnetic field generated by the permanent magnet 12 and the non-permanent magnet 13 is therefore radiated in the air gap 14, reaching the coil 11 housed there.

Since the coil 11 may be connected in a circuit to an electric generator of the conventional type and not illustrated, electrical energizing of the coil 11 interacting with the magnetic field produces a force F which is applied to the first, moving component 9 of the actuator 8 and which can cause it to move in a direction labeled 15.

Depending on the degree of damping desired, the force F applied to the first, moving component 9 of the actuator 8 may be of different intensities (depending on the application context of the particular exercise apparatus to which the device 1 is applied, or depending on the particular use to be made of an apparatus), normally variable from one case to another and/or from one user to another of the exercise apparatus in question.

Figure 12:
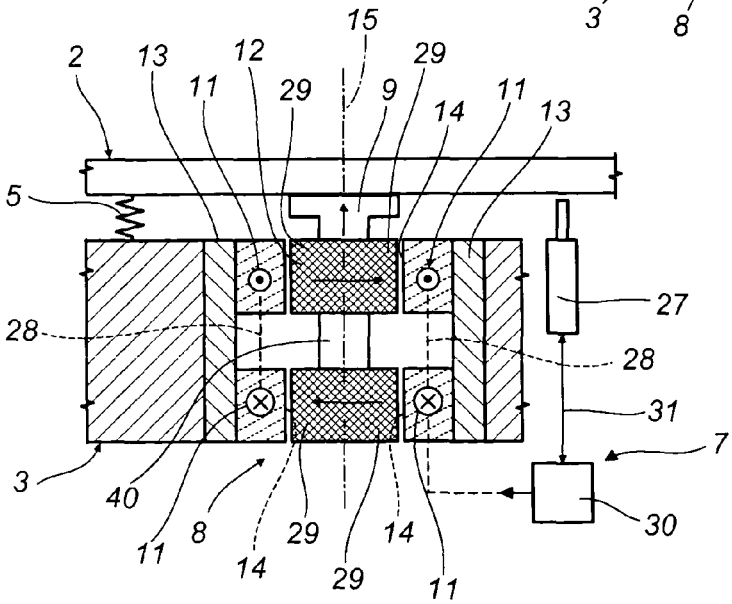
FIG. 12 is a diagram illustrating a second embodiment of the device made in accordance with the present invention.

For this reason, the device 1 comprises adjusting means—visible on the right-hand side of FIG. 12 and labeled 7 as a whole—which control the damping capacity of the device 1, adjusting one or more of the parameters representing coil 11 electrical energizing.

More specifically, the adjusting means 7 include a control unit 30 designed to control coil 11 electrical energizing, making it depend on signals 31 from the detector means 27 sensitive to variations in a suitably predetermined control parameter.

The control parameter may be an electrical measurement, for example, the coil power supply voltage, or a physical parameter of the device, such as the electrical resistance or the number of loops in the coil.

The adjusting means 7 may be designed, for example, in such a way as to modulate the coil 11 electric power supply voltage, according to the current position of the moving part 2 relative to the support member 3. This position is detected by the detector means 27 which, being designed and prepared specifically for this purpose, may include for example a proximity sensor suitably connected to the moving part 2.

Obviously, the control may equally be made dependent on the control unit 30 receiving signals 31 carrying other types of information, such as the intensity of the force exchanged between the user and the apparatus during exercising, or signals 31 relative to the weight of the user, or directly or indirectly linked to this, or signals 31 proportional to or a function of the speed of the sliding belt, or even signals 31 obtained from a suitable combination of information relative to these variables.

A comparison of FIGS. 12 and 11 reveals that the actuator 8 may be made with at least two different construction methods. A first embodiment, illustrated in FIGS. 10 and 11 requires connection of the coil 11 to the moving component 9, whilst the permanent magnet 12 and the non-permanent magnet 13 are both connected to the fixed support member 3.

On the other hand, in the embodiment in FIG. 12, whilst the non-permanent magnet 13 is again statically connected to the fixed support member 3, the positions of the permanent magnet 12 and the coil 11 are precisely reversed. In this embodiment, the coil 11—or rather two coils 11—are connected to the static support member 3, whilst the permanent magnets 12 are connected to the first, moving component 9 of the actuator 8.

Since in this case two separate permanent magnets 12 are arranged in such a way that they continue on from one another along the direction of movement 15 of the component and two coils 11 are connected to the non-permanent magnet 13, two air gaps 14 are created: the result being that, all conditions being equal, the moving component 9 of the actuator 8 is subjected a greater force, in theory double that of the solution in FIG. 11.

Observation of FIGS. 11 and 12 shows how the mass and dimensions of the first, moving component 9—which may be very small, at least as regards fulfilling their task of supporting the coil 11—confirms that the actuator 8, and as a result the entire device 1, can have very small masses and compact overall dimensions. As regards the importance of the suspended masses, it is easy to see, again in FIG. 11, how the total suspended mass is derived from the sum of the small mass of the coil 11 and the mass of the core of the first, moving component 9. The mass of the latter can be kept quite low with a careful choice of material.

As regards the solution in FIG. 12, it is clear that the situation is less favorable in terms of the size of the suspended masses. However, the double air gap 14 may be used to advantage for a coil 11 with reduced height, that is to say, a smaller size in terms of the dimension detected parallel with the direction of movement 15 of the first, moving component 9. This allows the actuator 8 to be housed in a seat in the support member 3 which is correspondingly lower.

For all of the above-mentioned reasons and strictly in terms of application—the device 1 disclosed can easily be inserted between the moving part 2 and the support member 3 of the exercise apparatus. This allows the advantage of not influencing the overall dimensions of the exercise apparatus on which it is designed to be used.

The above description refers to electroconductive elements 11 made in the form of coils through which an electric current flows, conveniently generated by an external generator, that is to say, reference is made to so-called active electroconductive elements 11. However, this must not be considered a limiting factor, since equivalent and equally effective passive embodiments are also possible.

It is easy to understand that even in the absence of a current generator, the coil may be the seat of an induced electromotive force, caused by the movement of the first component 9 and which, opposing the movement, performs its damping action.

Remaining on the subject of passive electroconductive elements 11, another, even simpler embodiment of the device 1 may be obtained if the core 40 is used as the seat for formation of the induced electromotive forces. For example, this may be made in the form of a monolithic aluminum element, or in the form of lamellar bars obtained by assembling a plurality of layers of metal.

In the latter embodiments of the invention, the damping may be easily adjusted by controlled variation of the size of the air gap 14 or with similar means designed to adjust some of the device 1 magnetic circuit parameters.

Figure 3:
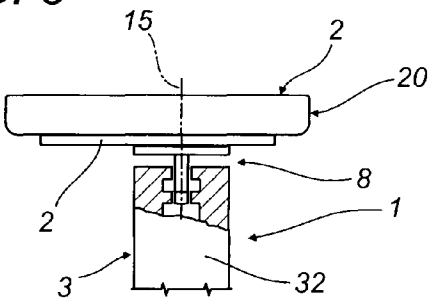
FIGS. 3 and 4 are respectively a front perspective view and a top plan view of a user support part in a generic exercise apparatus, the support part being made in accordance with a first embodiment of the present invention.
Figure 4:
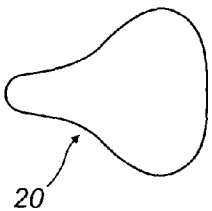

The device 1 described above fulfills the aims of overcoming the disadvantages of the prior art and may be connected to many different types of exercise apparatuses, or to different parts of each apparatus. Observation of FIGS. 3 and 4 reveals how the device can be advantageously connected to a saddle 20, for example of a "bike", whose structure includes the moving part 2. The saddle is attached to a column 32 which in turn constitutes the support member 3. The saddle supports the apparatus user.

Figure 5:
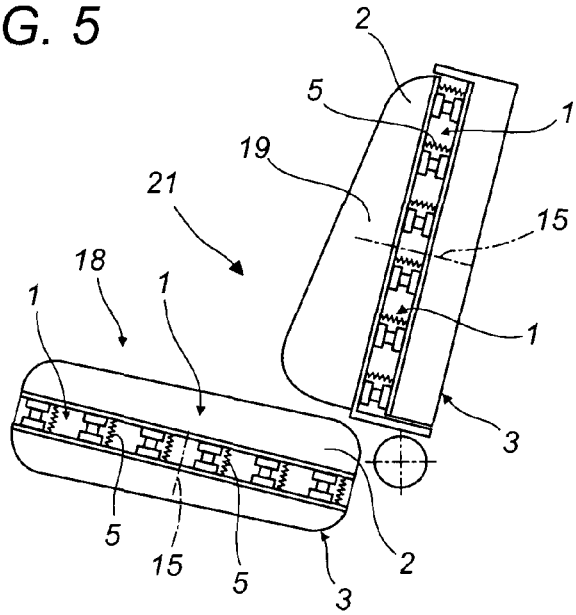
FIG. 5 is a front perspective view of a second embodiment of the support part illustrated in FIGS. 3 and 4.

Still on the subject of methods for supporting the user, another example application is illustrated in FIG. 5, where a plurality of devices 1 is attached to a seat cushion 18 and a back cushion 19 of a seat 21 of the type normally used on many exercise machines or items of equipment.

Figure 9:
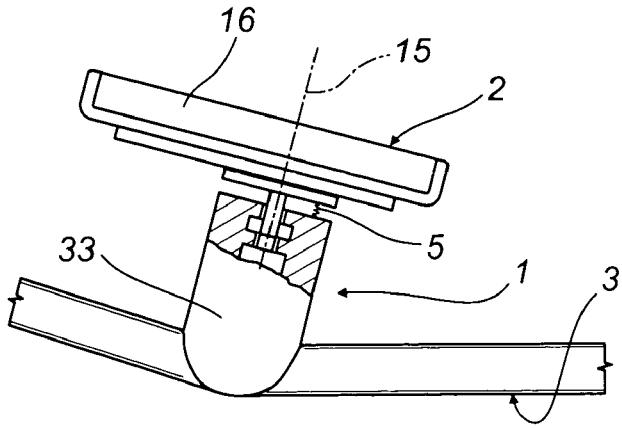
FIG. 9 is a schematic elevation view of a partially illustrated exercise machine, equipped with a platform to which an apparatus made in accordance with the present invention is applied.

The device 1 may also be applied to a platform 16 which in FIG. 9 is represented as being applied to a structure of an exercise apparatus, only partially illustrated. The platform 16, incorporating the moving part 2 of the device designed to receive a muscular force statically exerted by the user, is supported by a fixed column 33, forming the apparatus support member 3.

Figure 6:
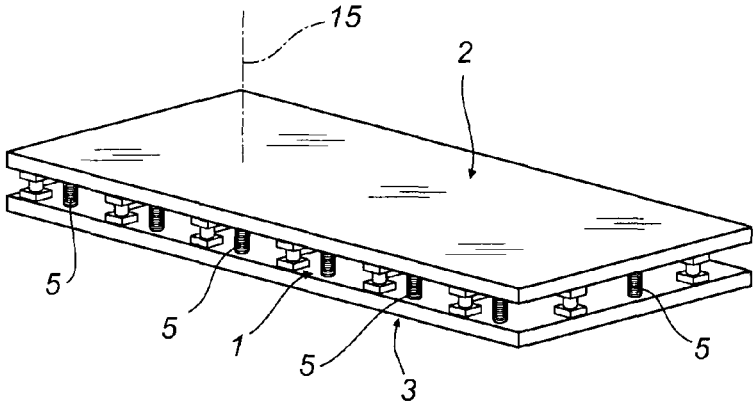
FIG. 6 is a perspective assembly view of a third embodiment of the exercise apparatus which uses devices made in accordance with the present invention.

The device 1 may be advantageously applied to a surface 17 of the type illustrated in FIG. 6 which may form an elastic platform and which may be inserted structurally and operationally in a more complex machine.

Figure 1:
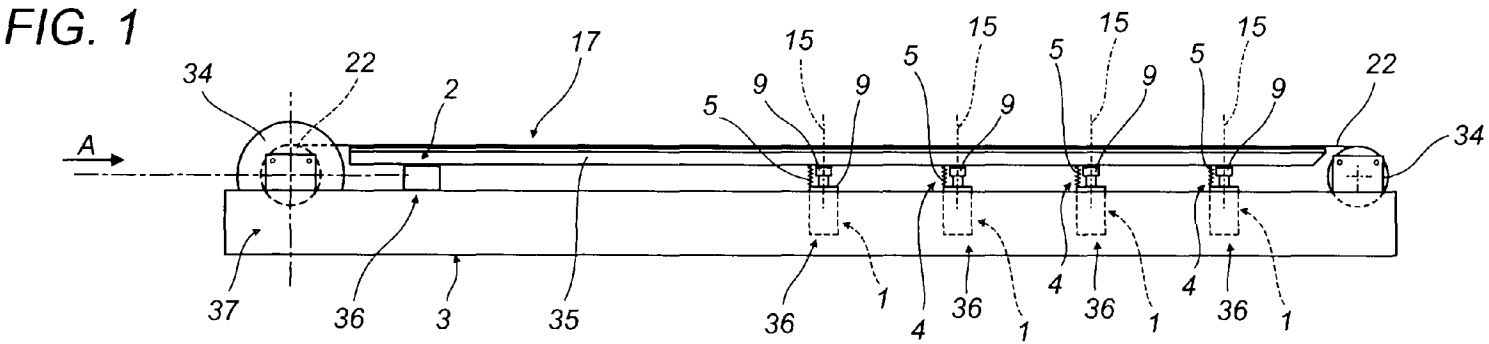
FIG. 1 is an elevation view of a first exercise apparatus which uses devices made in accordance with the present invention; an apparatus which can normally be traced back to a conventional type of machine, known as a "treadmill"
Figure 2:
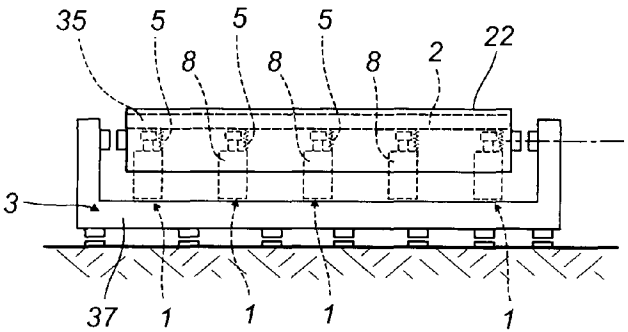
FIG. 2 is a front view of the apparatus illustrated in FIG. 1, seen in the direction indicated by the arrow A in FIG. 1.

FIGS. 1 and 2 illustrate another example of application of the exercise apparatus in which a plurality of devices 1 made in accordance with the present invention are applied to an exercise apparatus—conventionally known as a "treadmill"—and as such basically equipped with a user support part, in the form of a horizontal moving surface, labeled 17 as a whole. The surface 17 has a sliding belt in the form of an endless flexible belt 22 looped around two rollers 34 with horizontal axes, one roller being motor-driven. The user exercises by getting onto the surface 17, walking or running on the sliding belt 22, while the belt slides at a suitable speed.

A rigid part, in particular having the shape of a flat plate 35 is inserted between the rollers 34 and supported under the belt 22 by a plurality of supports 36 projecting from a horizontal frame 37 below. The supports 36 incorporate a corresponding plurality of devices 1 in which the moving component 9 of the actuator is fixed to the plate 35 above and in which the second, fixed component 10 is made integral with the horizontal frame 37. The devices 1 allow the belt 22 to be given an elastically yielding and dampened support so that user impact with the belt 22, or rather with the flat plate 35 below it, is more gradual and comfortable.

Further examples of possible applications of the invention may be obtained by imagining that the devices 1 are inserted in the actuator parts on which the user exerts a direct muscular force, or even directly on the resistive means which provide resistance to use of the apparatus 1 by the user.

Figure 7:
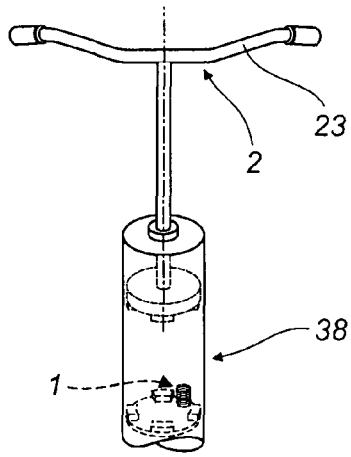
FIGS. 7 and 8 are schematic views of some parts of exercise apparatuses made in accordance with the present invention.

For example, this may be done as illustrated in FIG. 7, which schematically illustrates a handle 23 which can be gripped by the user of the apparatus to which the device 1 is connected in order to dampen the stroke relative to a guide and support column 38.

Figure 8:
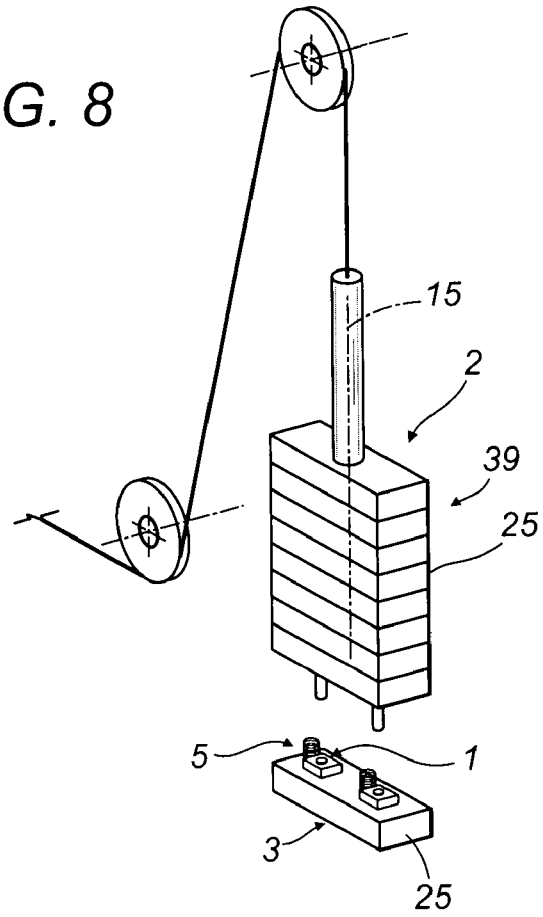

An alternative embodiment is illustrated in FIG. 8, which shows how the device 1 may be positioned below a pack 39 of weights, both to dampen the impact during the downstroke, and to facilitate initial detachment during lifting.

The invention described has evident industrial applications and can be subject to modifications and variations without thereby departing from the scope of the inventive concept. Moreover, all the details of the invention may be substituted by technically equivalent elements.

What is claimed is:

1. A damping support device for an exercise apparatus, in which the apparatus comprises a user interface moving part and a fixed support member, the moving part performing movements, towards or away from the fixed support member, correlated with the exchange of forces between the user and the apparatus; the device comprising supporting means with at least one elastic element positioned between the moving part and the fixed support member; means for damping the movements of the moving part relative to the support member; wherein the damping means of the device comprise at least one magnetic actuator with a first moving component integral with the moving part of the apparatus, and a second fixed component, integral with the support member; either the first component or the second component of the actuator having an electroconductive element designed to be the seat of an electromotive force, the other component comprising a permanent magnet and a non-permanent magnet, connected to one another in such a way as to form at least one air gap designed to radiate a magnetic field passing through the electroconductive element; electrical energizing of the electroconductive element producing a reactive magnetic force which, when applied to the moving part of the first component and of the second component, counteracts its translation in the direction of the movements of the moving part of the apparatus.

2. The device according to claim 1, wherein the electroconductive element is the seat of an electromotive force induced in it by the movement of the first component.

3. The device according to claim 1, wherein the electroconductive element is a core of the first, moving component.

4. The device according to claim 1, wherein the electroconductive element is an electrocondutive coil.

5. The device according to claim 4, wherein the electroconductive element is powered by an electrical generator.

6. The device according to claim 1, wherein the damping means are arranged parallel with the supporting means.

7. The device according to claim 4 and comprising means for adjusting the degree of damping, wherein the adjusting means control the degree of damping by varying the size of the air gap.

8. The device according to claim 7, wherein the adjusting means control the degree of device damping by adjusting at least one of the coil electrical energizing parameters.

9. The device according to claim 8, wherein the adjusting means control the degree of damping by varying the coil electrical resistance.

10. The device according to claim 8, wherein the adjusting means control the degree of damping by varying the number of loops in the coil.

11. The device according to claim 7, wherein the adjusting means are sensitive to the forces exchanged between the user and the apparatus, electrical energizing of the coil being adjusted according to the forces exchanged between the user and the apparatus.

12. The device according to claim 11, wherein the adjusting means are sensitive to at least a force proportional to the weight of the user.

13. The device according to claim 11, wherein the adjusting means are sensitive to at least a force proportional to the speed of a sliding belt.

14. The device according to claim 8, wherein the adjusting means are sensitive to the current relative position of the moving part and the support member, the adjusting means being designed to vary electrical energizing of the coil according to the relative position.

15. The device according to claim 8, wherein the adjusting means are sensitive to the forces exchanged between the user and the apparatus and to the relative position of the moving part and the support member; the adjusting means being designed to vary electrical energizing of the coil according to the forces exchanged between the user and the exercise apparatus and according to the current, relative position of the moving part and the support member.

16. The device according to claim 4, wherein the adjusting means are designed to control electrical energizing of the coil by control and management of an electrical voltage applied to it.

17. The device according to claim 1, wherein the electroconductive element is connected to the first component of the actuator which moves together with the moving part of the exercise apparatus.

18. The device according to claim 17, wherein the first, moving component of the actuator is adjacent to at least two air gaps which, with reference to the direction of movement of the first component, are reciprocally and longitudinally consecutive.

19. The device according to claim 1, wherein the electroconductive element or elements are connected to the second component of the actuator, the latter being integral with the support member, the one or more permanent magnets being connected to the first, moving component of the magnetic actuator.

20. The device according to claim 1, wherein the moving part is designed in such a way that it forms a rest for supporting the user of the exercise apparatus.

21. The device according to claim 20, wherein the moving part includes a platform.

22. The device according to claim 20, wherein the moving part includes a surface.

23. The device according to claim 20, wherein the moving part includes a seat cushion.

24. The device according to claim 20, wherein the moving part includes a back cushion.

25. The device according to claim 20, wherein the moving part includes a saddle.

26. The device according to claim 20, wherein the moving part includes a seat.

27. The device according to claim 21, wherein the platform is interconnected with a structure of an exercise apparatus which receives a muscular force statically exerted by the user.

28. The device according to claim 22, wherein the surface is included in an exercise apparatus with a sliding belt on which the user exercises with a walking movement.

29. The device according to any one of the claims from 1 to 19, wherein the moving part includes an actuating element, to which the user applies a muscular force generated with his or her limbs.

30. The device according to claim 29, wherein the actuating element includes a handle which can be used by the user.

31. The device according to any one of the claims from 1 to 19, wherein the moving part and the support member are operatively connected to at least one weight designed to generate a reaction to a driving action applied by the user.

* * * * *